US007805805B2

(12) United States Patent
Loveless

(10) Patent No.: US 7,805,805 B2
(45) Date of Patent: Oct. 5, 2010

(54) VACUUM ASSISTED SCRAPER

(75) Inventor: Michael Loveless, Price, UT (US)

(73) Assignee: Loveless Ash Company, Inc., Price, UT (US)

( * ) Notice: Subject to any disclaimer, the term of this patent is extended or adjusted under 35 U.S.C. 154(b) by 487 days.

(21) Appl. No.: 11/559,292

(22) Filed: Nov. 13, 2006

(65) Prior Publication Data

US 2008/0109986 A1 May 15, 2008

(51) Int. Cl.
*A47L 9/06* (2006.01)

(52) U.S. Cl. ..... 15/401; 15/246.2

(58) Field of Classification Search ..... 15/401, 15/402, 410, 246.2, 236.01, 393
See application file for complete search history.

(56) References Cited

U.S. PATENT DOCUMENTS

| | | | | |
|---|---|---|---|---|
| 2,867,835 | A * | 1/1959 | Brown, Jr. et al. | 15/328 |
| 2,879,530 | A | 3/1959 | Ego | |
| 2,893,046 | A * | 7/1959 | Thompson | 15/325 |
| 3,079,623 | A * | 3/1963 | Congdon | 15/328 |
| 4,864,681 | A * | 9/1989 | Hult et al. | 15/367 |
| 4,947,515 | A | 8/1990 | Ivarsson | |
| 5,184,372 | A * | 2/1993 | Mache | 15/401 |
| 5,280,666 | A * | 1/1994 | Wood et al. | 15/401 |
| 5,575,035 | A | 11/1996 | Reis et al. | |
| 5,794,303 | A | 8/1998 | Sanfilippo et al. | |
| 5,951,781 | A | 9/1999 | Lucas | |
| 6,070,292 | A | 6/2000 | Langelaan | |
| 6,467,124 | B1 * | 10/2002 | Small | 15/401 |
| 6,601,266 | B1 | 8/2003 | Faraci et al. | |
| 2003/0145425 | A1 * | 8/2003 | Fernandez-Grandizo Martinez | 15/393 |
| 2003/0159241 | A1 | 8/2003 | Calzolari | |
| 2005/0144753 | A1 | 7/2005 | Pulliam | |

FOREIGN PATENT DOCUMENTS

| | | |
|---|---|---|
| GB | 821742 | 10/1959 |

* cited by examiner

*Primary Examiner*—Dung Van Nguyen
(74) *Attorney, Agent, or Firm*—Bateman IP Law Group

(57) ABSTRACT

A vacuum assisted scraper draws air from both in front of and behind the scraper blade to collect dust and debris as the scraper is used. The scraper keeps the work area clean and prevents dust buildup from hindering the use of the scraper.

23 Claims, 5 Drawing Sheets

VACUUM ASSISTED SCRAPER

BACKGROUND OF THE INVENTION

1. The Field of the Invention

The present invention relates to a hand held scraper which utilizes suction from a vacuum to remove dust and debris generated while scraping.

2. State of the Art

Hand-held scrapers are often used for removal of material from a surface. For example, scrapers may be used to remove material to shape a surface, to remove glue or foreign substances from a surface, to clean a surface, etc. Scrapers typically have a handle and a metal blade which is held roughly perpendicular or at an angle to the surface for use, and which scrapes material from the surface as the scraper is moved back and forth across the surface.

One drawback of using a scraper is that the material removed while scraping (dust, chips, shavings, etc.) typically remains on the surface or falls to the floor, bench, etc. Material which remains on the surface makes it difficult for the operator to see the item being scraped, and is often thrown about by subsequent scraping. The material then often ends up on the work bench, floor, etc. where it must be later removed. Often, the material removed while scraping falls on carpet or in crevices where it is difficult to remove. In many situations, such as cleaning a wall or fireplace in a finished house, it is particularly desirable to remove all of the dust and material generated while scraping without the material falling on carpet or other finished surfaces.

An attempt has been made to collect the material removed while scraping by combining a vacuum suction handle with a scraper blade, as shown in U.S. Pat. No. 6,070,292. While an improvement, the device only removes the dust, etc. from one side of the scraper blade. Scrapers are commonly used in both directions, creating dust on both sides of the blade. Dust and the like which is not removed from one side of the blade will typically be pushed about by that side of the blade and create a mess.

There is thus a need for a scraper which overcomes the limitations of available scrapers. Specifically, there is a need for a vacuum assisted scraper which removes the dust and debris generated while scraping from both sides of the blade.

SUMMARY OF THE INVENTION

It is an object of the present invention to provide an improved vacuum assisted scraper.

According to one aspect of the invention, a scraper is provided with a vacuum hood which extends to both sides of the blade, and which provides airflow to remove debris from both sides of the blade. The vacuum shroud may be formed to have the blade mount formed on the inside of the shroud, and may have air passages formed to direct air flow from both sides of the blade and into a vacuum port.

These and other aspects of the present invention are realized in a vacuum assisted scraper as shown and described in the following figure and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
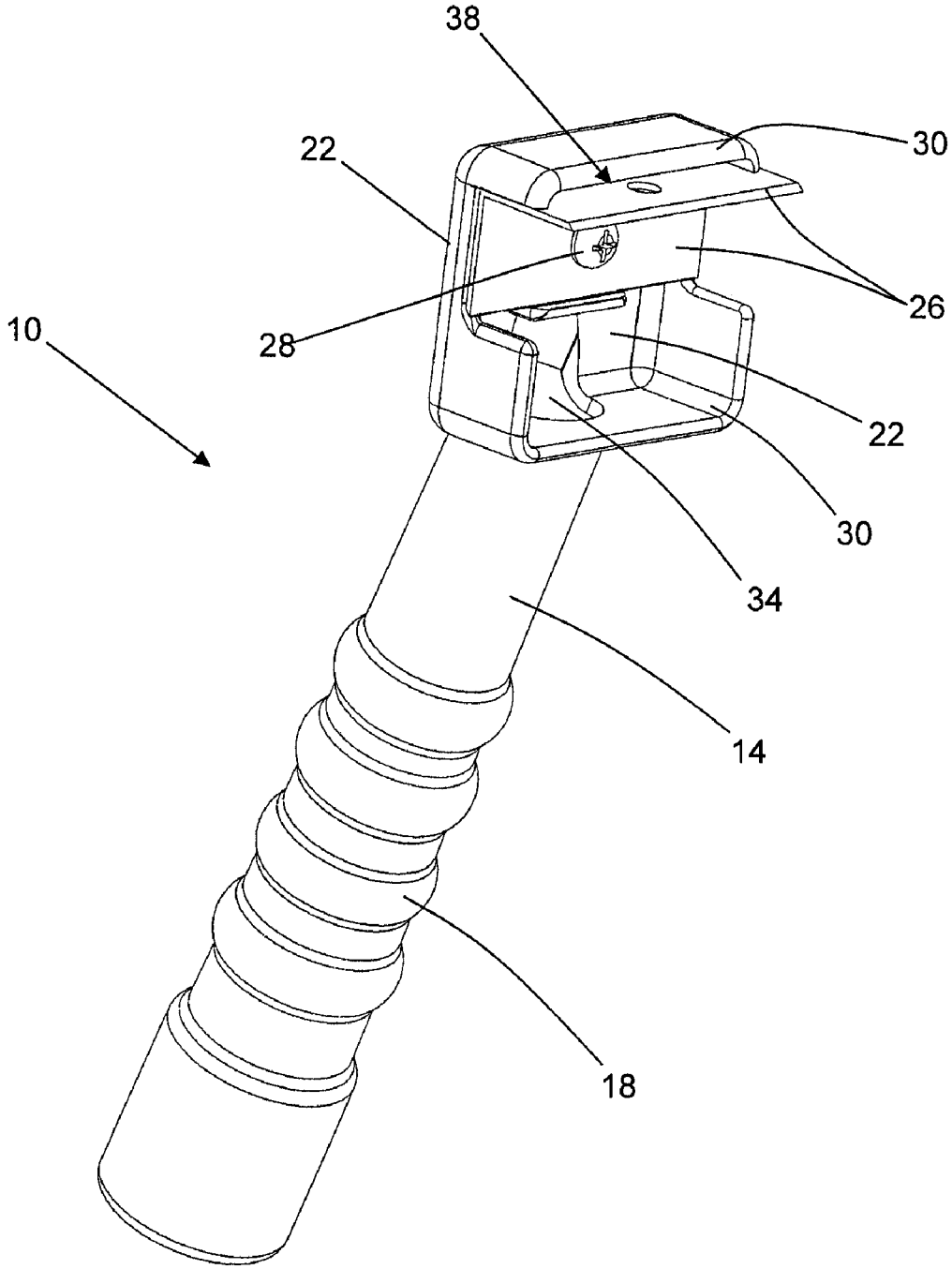
FIG. 1 shows a perspective view of the scraper of the present invention.

Turning now to FIG. 1, a perspective view of a scraper of the present invention is shown. The scraper 10 includes a handle 14 which may be formed with ridges 18, contours, or other structures to promote a firm and comfortable grip of the scraper 10. The handle 14 is connected to a scraper head 22 which is used to mount the blade 26. The scraper head 22 is generally flat and is shown as generally rectangular, but can be made in various shapes. The scraper head 22 both provides a mounting surface for the blade 26, and generally defines the area cleaned by the vacuum as the scraper is used.

The blade 26 is shown as a length of angle shaped steel. The angle shaped blade 26 provides two lateral scraping surfaces. A fastener 28, such as a bolt or screw, is used to hold the blade to the scraper head 22 and allows the blade to be changed. The blade 26 may be held such that one side of the blade is generally parallel to the scraper head 22 and the other side (used for scraping) is held generally perpendicular to the scraper head. The scraper head 22 includes a vacuum shroud 30 which is present both in front of and behind the blade 26.

The handle 14 is hollow, and the conduit therethrough is connected to the area enclosed by the vacuum shroud 30 via opening 34. A front airflow passage 38 is provided between the front of the blade 26 and the front of the vacuum shroud 30. The passage 38 allows air to flow upwardly between the blade 26 and the front portion of the vacuum shroud 30 and then above the blade 26 (between the blade 26 and shroud 30) towards the back portion of the vacuum shroud and towards the opening 34. Thus, airflow is provided from in front of and behind the blade, through opening 34 into the handle, and into a vacuum. The vacuum shroud 30 directs the vacuum generated air flow around both sides of the blade so as to aid in collecting dust and debris from both sides of the blade while using the scraper 10.

Figure 2:
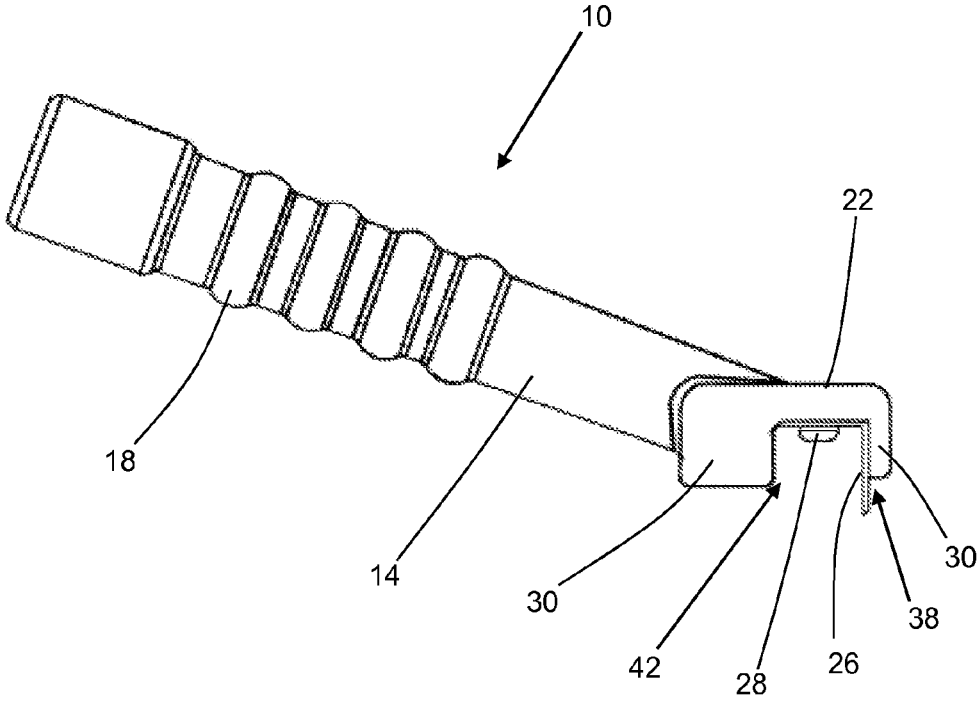
FIG. 2 shows a side view of the scraper of the present invention.

FIG. 2 shows a side view of the scraper 10 and illustrates how openings 42 may be made in the sides of the vacuum shroud 30 to increase the airflow past the back side of the blade (towards the handle). In some situations, more dust, or larger particles of dust, is generated at the back of the blade 26 while scraping.

Figure 3:
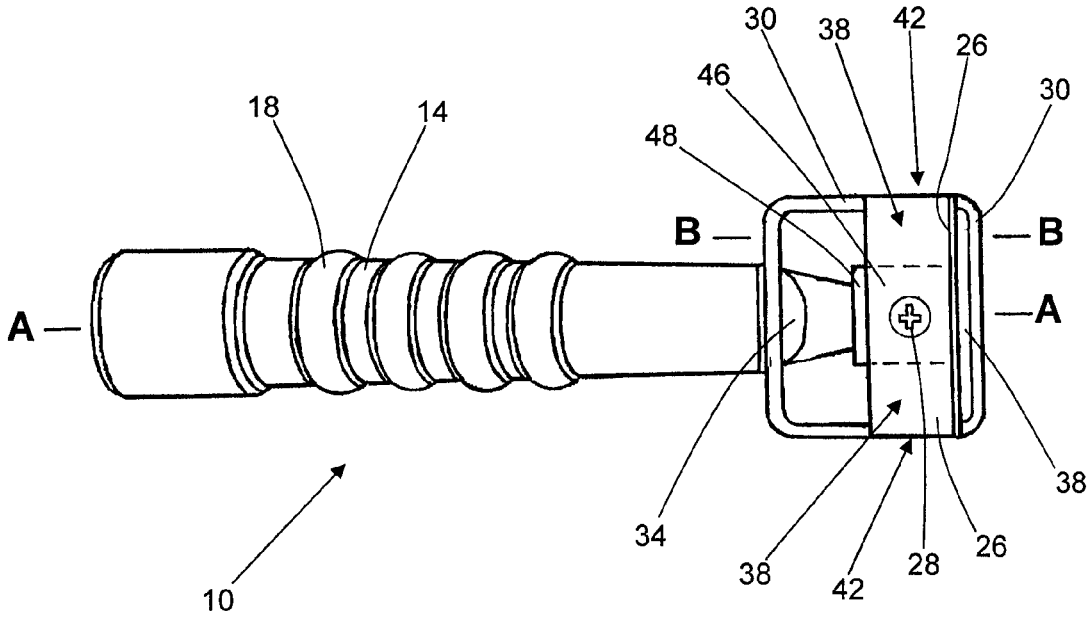
FIG. 3 shows a bottom view of the scraper of the present invention.

FIG. 3 shows a bottom view of the scraper 10. The opening 34 between the air passage in the handle 14 and the vacuum shroud 30 can be seen. Additionally, it can be seen how airflow passage 38 may extend across nearly the entire front of the blade 26, promoting good collection of the dust and debris created in front of the blade. The scraper head 22 typically has a mount 46 used to attach the scraper blade 26.

The mount 46 may be used to elevate the blade 26 from the surface of the head 22. The mount 46 may have a ridge 48 or other structure thereon (also visible in FIG. 4) to aid in preventing rotation of the blade 26 during use. The ridge 48 may also be used to cover the blade 26 adjacent the opening 34 to protect a user from cutting their finger when clearing debris from the opening 34. The front portion of the vacuum shroud 30 may also be used to maintain the desired alignment of the blade 26.

The portion of the mount 46 beneath the blade 26 (indicated by dashed lines) does not extend to the sides of the scraper head 22, extending the airflow passage 38 around the sides of the mount 46, between the blade 26 and the head 22. Thus, a vacuum will draw air between the blade 26 and airflow shroud 30 in front of the blade through airflow passage 38, the air passing around the sides of the mount 46, through opening 34, and through the handle to the vacuum. Dust and debris are thus removed from in front of the blade. Air is also drawn around the back portion of the vacuum shroud 30 and in openings 42, through the opening 34 and through the handle 14 to the vacuum, removing dust and debris from the back side of the blade. Thus, dust and debris are removed from both sides of the blade 26 as the scraper 10 is used.

Figure 4:
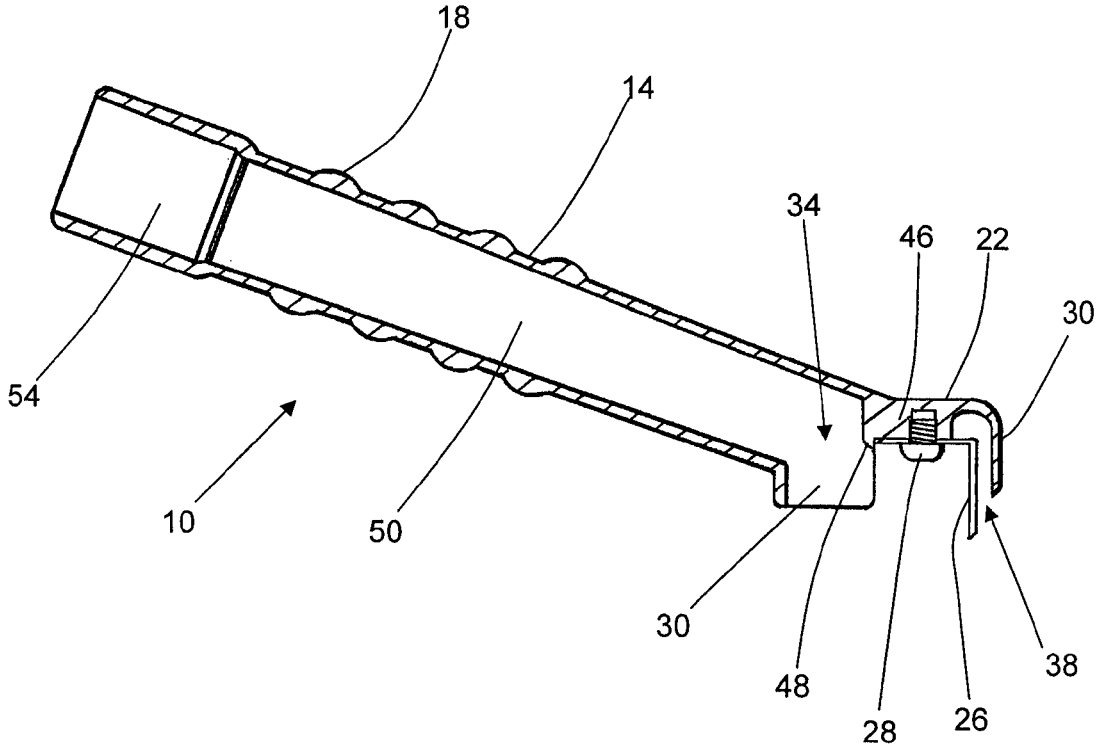
FIG. 4 shows a partial cross-sectional view of the scraper of the present invention.

FIG. 4 shows a partial cross-sectional view of the scraper 10 taken along line A-A of FIG. 3. The air conduit 50 through the handle 14 is clearly seen. The air conduit 50 may be formed with a socket 54, or enlarged portion, adjacent the end of the handle 14 which receives a vacuum hose, and which is typically sized to receive an ordinary 1.25 inch vacuum hose. Opening 34 is seen as the area where the conduit 50 opens into the area enclosed by the vacuum shroud 30. The mount 46 can be seen as a raised central portion of the head 22, and can be seen elevating the blade 26.

Figure 5:
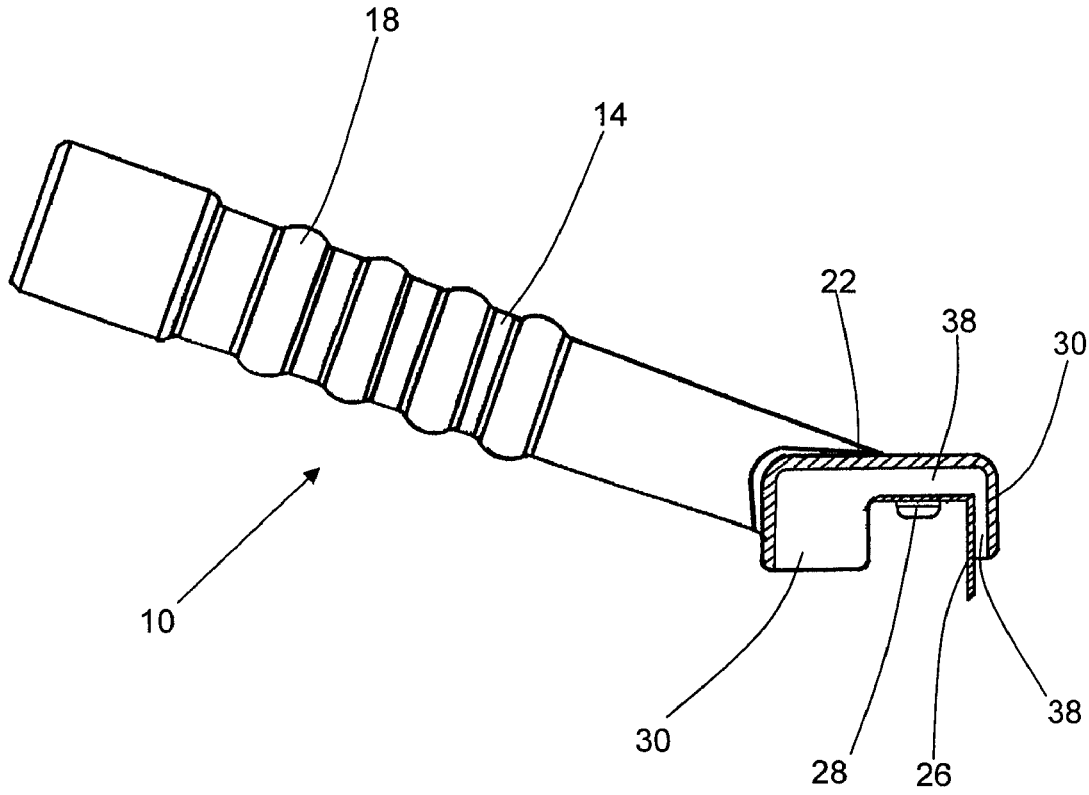
FIG. 5 shows a partial cross-sectional view of the scraper of the present invention.

FIG. 5 shows a partial cross-sectional view of the scraper 10 taken along line B-B of FIG. 3. The cross-sectional view of the scraper 10 does not pass through the mount, but runs along side thereof. It can be seen how the airflow passage 38 extends between the blade 26 and the head 22, extending the airflow passage around the mount (not seen) so as to allow air flow through airflow passage 38, around the sides of the mount, through opening 34 and into conduit 50 through the handle 14, where it passes into the vacuum.

FIG. 5 and FIG. 2 both illustrate how the scraper head 22 may be mounted at a slight angle to the handle 14 so as to make the scraper easier to use. As shown, the head 22 is mounted at an angle of about 20-25 degrees from being parallel to the handle, positioning the blade 26 at a corresponding angle from being perpendicular to the handle.

The present invention thus provides a scraper 10 which is connected to a vacuum and which draws air from both in front of and behind the blade 26 to remove dust and debris from both sides of the blade. The scraper is advantageous as it keeps the area clean while the scraper is being used, promoting easier use of the scraper.

There is thus disclosed an improved vacuum assisted scraper. It will be appreciated that numerous changes may be made to the present invention without departing from the scope of the claims.

What is claimed is:

1. A scraper comprising:

a handle;

a scraper head;

a rigid blade attached to the scraper head and configured for scraping a surface, the blade having a scraping edge, a front face contacting the scraping edge, and a back face contacting the scraping edge;

a vacuum port configured for attachment to a vacuum;

a front shroud wall extending generally parallel to the front face of the blade;

a back shroud wall extending generally parallel to the back face of the blade;

a front air flow channel formed between the front shroud wall and the front face of the blade;

a back air flow channel formed between the back shroud wall and the back face of the blade;

at least one conduit, the at least one conduit being fluidly connected to the vacuum port and to the front air flow channel and back air flow channel for simultaneously drawing air from both sides of the blade while scraping with the blade to thereby remove debris from both sides of the blade.

2. The scraper of claim 1, wherein the vacuum port is formed in an end of the handle, and wherein the handle defines an airflow conduit.

3. The scraper of claim 1, wherein the scraper head is generally planar, wherein the blade extends downwardly from the scraper head generally perpendicularly thereto, and wherein the front shroud wall and back shroud wall extend downwardly from the scraper head generally perpendicularly from the scraper head.

4. The scraper of claim 3, wherein the vacuum shroud is disposed in front of and behind the blade.

5. The scraper of claim 3, wherein the vacuum shroud extends around the perimeter of the scraper head and wherein a distal edge of the vacuum shroud and a scraping edge of the blade are generally coplanar, and wherein the vacuum shroud and blade are presented to a surface generally perpendicular thereto.

6. The scraper of claim 5, further comprising openings formed in the sides of the vacuum shroud.

7. The scraper of claim 1, wherein the scraper blade, front shroud wall, and back shroud wall extend parallel to each other.

8. The scraper of claim 1, wherein the front airflow channel extends between the blade and the scraper head.

9. The scraper of claim 1, wherein the scraper head further comprises a mount for attaching the blade thereto, and wherein the blade is spaced apart from the scraper head such that air can flow between the blade and the scraper head.

10. A scraper comprising:

a handle;

a scraper head;

a rigid blade attached to the scraper head and configured for scraping a surface;

a vacuum port configured for attachment to a vacuum, wherein the vacuum port is formed in an end of the handle, and wherein the handle defines an airflow conduit;

a vacuum shroud disposed around at least a portion of the scraper head, the vacuum shroud extending generally perpendicular from the scraper head, wherein the vacuum shroud is disposed in front of and behind the blade, and wherein the vacuum shroud in front of the blade and the vacuum shroud behind the blade extend generally parallel with each other and with the blade;

further comprising a front airflow passage between the front of the blade and the vacuum shroud, wherein the front airflow passage extends between the blade and the scraper head;

at least one conduit, the at least one conduit being fluidly connected to the vacuum port and to openings on both sides of the scraper blade for simultaneously drawing air from both sides of the blade while scraping with the blade to thereby remove debris from both sides of the blade;

wherein the blade has an angle-shaped cross-section having a first side and a second side, and wherein the first side is generally parallel to the scraper head and the second side is generally perpendicular to the scraper head, and wherein the front airflow passage extends between the first side of the blade and the scraper head.

11. A scraper comprising:

a scraper head;

a rigid blade mounted to the scraper head;

a handle, the handle comprising a first end having a socket configured for receiving a vacuum hose, a second end connected to the scraper head, and a conduit fluidly connecting the socket to an opening in the scraper head; and a front shroud wall generally parallel to a front face to the blade and disposed adjacent a scraping edge of the blade;

a back shroud wall proximate to the back face of the blade and joining with the handle side of the scraper head;

wherein the scraper head is configured such that air flows simultaneously from a first area bounded by the front of the blade and the front shroud wall and a second area bounded by the back of the blade and the back shroud wall while scraping with the blade, through the opening in the scraper head, and through the conduit when the socket is connected to a vacuum source.

12. The scraper of claim 11, wherein the scraper head is mounted at an angle of about 20 degrees from parallel relative to the handle.

13. The scraper of claim 12, wherein the front shroud wall and back shroud wall form a vacuum shroud disposed generally around the blade.

14. The scraper of claim 13, wherein the vacuum shroud is disposed around the perimeter of the scraper head.

15. The scraper of claim 13, further comprising openings disposed in the vacuum shroud.

16. The scraper of claim 15, wherein the openings are disposed adjacent the ends of the blade.

17. The scraper of claim 13, further comprising an airflow passage disposed between the front of the blade and the vacuum shroud.

18. The scraper of claim 17, wherein the airflow passage extends between the blade and the scraper head.

19. The scraper of claim 18, wherein the blade forms a portion of the airflow passage.

20. A scraper comprising:

a handle having a first end and a second end, the first end comprising a socket for receiving a vacuum hose;

a scraper head having a first end and a second end, the first end of the scraper head being attached to the second end of the handle;

a rigid blade attached to the scraper head between the first end and second end of the scraper head, the blade having a first side disposed immediately adjacent a scraping edge thereof and a second side disposed immediately adjacent said scraping edge;

a vacuum shroud attached to the scraper head, the shroud having a first end and a second end, wherein the first end of the shroud is proximate to the first end of the scraper head and extends along the first side of the blade, wherein the second end of the shroud is generally parallel to the second end of the scraper head and extends along the second side of the blade;

wherein the handle comprises a conduit connecting the socket to the first end of the scraper head so as to draw air from around the first side of the blade; and further comprising an airflow passage in the scraper head in fluid connection with the socket and conduit to thereby draw air from the second side of the blade such that air is simultaneously drawn from both an area bounded by the first end of the shroud and the first side of the blade and an area bounded by the second end of the shroud and the second side of the blade while the scraper is in use.

21. The scraper of claim 20, wherein the vacuum shroud and the scraping edge of the blade are generally coplanar.

22. The scraper of claim 20, wherein the airflow passage extends between the blade and the scraper head.

23. The scraper of claim 21, wherein the vacuum shroud and the blade are both presented to a surface which is to be scraped at about a 90 degree angle.

* * * * *